US010208574B2

(12) United States Patent
Least et al.

(10) Patent No.: US 10,208,574 B2
(45) Date of Patent: Feb. 19, 2019

(54) CONTROLLING FLOW IN A WELLBORE

(71) Applicant: Halliburton Energy Services, Inc., Houston, TX (US)

(72) Inventors: Brandon Thomas Least, Dallas, TX (US); Jean Marc Lopez, Plano, TX (US); William Mark Richards, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 370 days.

(21) Appl. No.: 14/776,361

(22) PCT Filed: Apr. 5, 2013

(86) PCT No.: PCT/US2013/035433
§ 371 (c)(1),
(2) Date: Sep. 14, 2015

(87) PCT Pub. No.: WO2014/163647
PCT Pub. Date: Oct. 9, 2014

(65) Prior Publication Data

US 2016/0032694 A1 Feb. 4, 2016

(51) Int. Cl.
*E21B 43/12* (2006.01)
*E21B 43/08* (2006.01)

(52) U.S. Cl.
CPC ..... *E21B 43/12* (2013.01); *E21B 43/08* (2013.01); *E21B 43/084* (2013.01); *E21B 43/086* (2013.01); *E21B 43/088* (2013.01)

(58) Field of Classification Search
CPC ..... E21B 43/12
See application file for complete search history.

(56) References Cited

U.S. PATENT DOCUMENTS

| | | | |
|---|---|---|---|
| 5,435,393 | A | 7/1995 | Brekke et al. |
| 5,803,179 | A | 9/1998 | Echols et al. |
| 6,112,815 | A | 9/2000 | Boe et al. |
| 7,048,061 | B2 | 5/2006 | Bode et al. |
| 7,469,743 | B2 | 12/2008 | Richards |

(Continued)

FOREIGN PATENT DOCUMENTS

| | | |
|---|---|---|
| EP | 2550427 | 1/2013 |
| WO | WO 2002/075110 | 9/2002 |

OTHER PUBLICATIONS

PCT International Preliminary Report on Patentability, PCT/US2013/035433, dated Oct. 15, 2015, 14 pages.

(Continued)

*Primary Examiner* — D. Andrews
*Assistant Examiner* — Kristyn A Hall
(74) *Attorney, Agent, or Firm* — Scott Richardson Parker Justiss, P.C.

(57) ABSTRACT

Techniques for controlling flow of a wellbore fluid include positioning a plurality of inflow control assemblies on a pipe joint in a wellbore, the pipe joint including a proximal end engageable with a first downhole tool and a distal end engageable with a second downhole tool; receiving a flow of a wellbore fluid from a subterranean zone to an inlet of at least one inflow control device (ICD), the at least one ICD mounted in each of the plurality of inflow control assemblies, the flow at a velocity that is less than the transport velocity of fines in the wellbore fluid; and transmitting the flow of the wellbore fluid to the pipe joint from the ICDs to an interior of the pipe joint.

23 Claims, 8 Drawing Sheets

(56) References Cited

U.S. PATENT DOCUMENTS

| | | | |
|---|---|---|---|
| 7,802,621 | B2 | 9/2010 | Richards et al. |
| 7,900,705 | B2 | 3/2011 | Patel |
| 8,196,653 | B2 | 6/2012 | Fripp et al. |
| 8,261,839 | B2 | 9/2012 | Fripp et al. |
| 8,276,669 | B2 | 10/2012 | Dykstra et al. |
| 8,316,952 | B2 | 11/2012 | Moen |
| 8,356,668 | B2 | 1/2013 | Dykstra et al. |
| 8,757,252 | B2 | 6/2014 | Franklin et al. |
| 8,919,435 | B2 | 12/2014 | Greci et al. |
| 9,080,421 | B2 | 7/2015 | Holderman et al. |
| 2010/0276927 | A1 | 11/2010 | Simonian et al. |
| 2011/0067886 | A1 | 3/2011 | Moen |
| 2012/0255740 | A1 | 10/2012 | Fripp et al. |
| 2014/0069627 | A1 | 3/2014 | Least |

OTHER PUBLICATIONS

M.A. Biot and W.L. Medlin, "Theory of Sand Transport in Thin Fluids," SPE 14468, 60th Annual Technical Conference and Exhibition of the Society of Petroleum Engineers, Sep. 22-25, 1985 (24 pages).

F.B. Soepyan et al., "Selection of the Optimal Critical Velocity for Sand Transport at Low Concentrations for Near-Horizontal Flow," OTC 23075, Offshore Technology Conference, Apr. 30-May 3, 2012 (7 pages).

Harold D. Brannon et al., "A New Correlation for Relating the Physical Properties of Fracturing Slurries to the Minimum Flow Velocity Required for Transport," SPE 106312, 2007 SPE Hydraulic Fracturing Technology Conference, Jan. 29-31, 2007 (11 pages).

PCT International Search Report and Written Opinion of the International Searching Authority, PCT/US2013/035433, dated Dec. 24, 2013, 18 pages.

CONTROLLING FLOW IN A WELLBORE

CROSS-REFERENCE TO RELATED APPLICATIONS

This application is a 371 U.S. National Phase Application of and claims the benefit of priority to International Application Serial No. PCT/US2013/035433, filed on Apr. 5, 2013 and entitled "Controlling Flow in a Wellbore", the contents of which are hereby incorporated by reference.

BACKGROUND

The present disclosure relates to well systems, and more particularly to controlling flow in well systems.

It is often desirable to control fluid flow into the completion string of a well system, for example, to balance inflow of fluids along the length of the well. For instance, some horizontal wells have issues with the heel-toe effect, where gas or water cones in the heel of the well and causes a difference in fluid influx along the length of the well. The differences in fluid influx can lead to premature gas or water break through, significantly reducing the production from the reservoir. Inflow control devices (ICD) can be positioned in the completion string at heel of the well to stimulate inflow at the toe and balance fluid inflow along the length of the well. In another example, different zones of the formation accessed by the well can produce at different rates. ICDs can be placed in the completion string to reduce production from high producing zones, and thus stimulate production from low or non-producing zones. Finally, ICDs can be used in other circumstances to balance or otherwise control fluid inflow.

SUMMARY

In one general implementation, a wellbore flow control apparatus includes a plurality of inflow control assemblies engageable with a pipe joint that includes a proximal end engageable with a first downhole tool and a distal end engageable with a second downhole tool; and at least one inflow control device (ICD) mounted in each of the plurality of inflow control assemblies, each of the inflow control devices including an inlet adapted to receive a flow of a wellbore fluid at a flow velocity that is less than a transport velocity of fines in the wellbore fluid, and an outlet adapted to transmit a flow of the wellbore fluid to the pipe joint.

In a first aspect combinable with the general implementation, each of the plurality of inflow control assemblies includes a housing engageable with the pipe joint, the at least one ICD mounted at least partially within the housing.

In a second aspect combinable with any of the previous aspects, the housing is threadingly engageable with one of the proximal or distal ends of the pipe joint.

In a third aspect combinable with any of the previous aspects, at least one of the plurality of inflow control assemblies includes an end inflow control assembly.

In a fourth aspect combinable with any of the previous aspects, the end inflow control assembly includes a wellbore fluid inlet positioned on only one axial surface of the end inflow control assembly.

In a fifth aspect combinable with any of the previous aspects, at least one of the plurality of inflow control assemblies includes a middle inflow control assembly engageable with the pipe joint between the end inflow control assembly and one of the proximal or distal ends of the pipe joint.

In a sixth aspect combinable with any of the previous aspects, the middle inflow control assembly includes wellbore fluid inlets positioned on respective axial surfaces of the middle inflow control assembly.

In a seventh aspect combinable with any of the previous aspects, the middle inflow control assembly includes another wellbore fluid inlet positioned on a radial surface of the middle inflow control assembly.

An eighth aspect combinable with any of the previous aspects further includes a filter that extends between the end inflow control assembly and another end flow control assembly such that a radial gap is defined between an outer surface of the pipe joint and the filter.

In a ninth aspect combinable with any of the previous aspects, the middle inflow control assembly is engageable with the pipe joint in the gap and between the filter and the outer surface of the pipe joint.

In a tenth aspect combinable with any of the previous aspects, the middle inflow control assembly is engageable with the pipe joint and the screen and is positioned in the gap with an outer radial surface of the middle inflow control assembly spaced apart from the outer surface of the pipe joint an equidistant as the filter.

In an eleventh aspect combinable with any of the previous aspects, a porosity of the filter is selected so that fines in the wellbore fluid flow through the filter with the wellbore fluid.

In a twelfth aspect combinable with any of the previous aspects, the filter includes at least one of a wire wrap, a mesh screen, a slotted liner, a perforated shroud, or a prepack screen.

In a thirteenth aspect combinable with any of the previous aspects, the housing includes a filter that extends to enclose at least a portion of the ICD.

In a fourteenth aspect combinable with any of the previous aspects, the filter extends to enclose the plurality of ICDs.

In a fifteenth aspect combinable with any of the previous aspects, the filter includes a plurality of filter sections, each filter section enclosing at least a portion of one of the plurality of ICDs.

A sixteenth aspect combinable with any of the previous aspects further includes a divider positioned in a gap between adjacent filter sections.

In a seventeenth aspect combinable with any of the previous aspects, the divider includes swell rubber.

In an eighteenth aspect combinable with any of the previous aspects, each of the ICDs includes at least one of a nozzle, an orifice, a helix channel, one or more tubulars, or an autonomous ICD.

In another general implementation, a method for controlling flow of a wellbore fluid includes positioning a plurality of inflow control assemblies on a pipe joint in a wellbore, the pipe joint including a proximal end engageable with a first downhole tool and a distal end engageable with a second downhole tool; receiving a flow of a wellbore fluid from a subterranean zone to an inlet of at least one inflow control device (ICD), the at least one ICD mounted in each of the plurality of inflow control assemblies, the flow at a velocity that is less than the transport velocity of fines in the wellbore fluid; and transmitting the flow of the wellbore fluid to the pipe joint from the ICDs to an interior of the pipe joint.

A first aspect combinable with the general implementation further includes receiving the flow of the wellbore fluid at a housing that at least partially encloses the ICD; and distributing the flow of the wellbore fluid through a portion of the housing to the ICD.

In a second aspect combinable with any of the previous aspects, distributing the flow of the wellbore fluid through a portion of the housing to the ICD includes distributing the flow of the wellbore fluid through one or more axially-facing inlets of the housing.

In a third aspect combinable with any of the previous aspects, distributing the flow of the wellbore fluid through a portion of the housing to the ICD further includes distributing the flow of the wellbore fluid through a radially-facing inlet of the housing.

A fourth aspect combinable with any of the previous aspects further includes receiving the flow of the wellbore fluid through a filter that extends at least partially between the proximal and distal ends of the pipe joint and into a radial gap defined between an outer surface of the pipe joint and the filter.

In a fifth aspect combinable with any of the previous aspects, receiving the flow of the wellbore fluid through a filter includes receiving fines in the flow of the wellbore fluid through the filter; and circulating the fines in the flow of the wellbore fluid to the inlet of the at least one ICD.

A sixth aspect combinable with any of the previous aspects further includes receiving the flow of the wellbore fluid through a filter that extends to enclose at least a portion of the ICD.

In a seventh aspect combinable with any of the previous aspects, the filter extends to enclose the plurality of ICDs.

In an eighth aspect combinable with any of the previous aspects, the filter includes a plurality of filter sections, each filter section enclosing at least a portion of one of the plurality of ICDs.

In a ninth aspect combinable with any of the previous aspects, receiving a flow of a wellbore fluid at a velocity that is less than the transport velocity of fines in the wellbore fluid includes restricting a flow rate of the wellbore fluid entering the at least one ICD based on a property of the wellbore fluid; and modifying a velocity of the flow of the wellbore fluid to be less than the transport velocity of fines in the wellbore fluid based on the restriction.

In a tenth aspect combinable with any of the previous aspects, the wellbore fluid includes a hydrocarbon fluid and an aqueous fluid.

In an eleventh aspect combinable with any of the previous aspects, restricting a flow rate of the wellbore fluid entering the at least one ICD based on a property of the wellbore fluid includes restricting a flow rate of the wellbore fluid entering the at least one ICD based on a difference in a property of the hydrocarbon fluid and a property of the aqueous fluid.

In a twelfth aspect combinable with any of the previous aspects, the property includes a viscosity, a velocity, or a density of the wellbore fluid.

In a thirteenth aspect combinable with any of the previous aspects, restricting a flow rate of the wellbore fluid entering the at least one ICD based on a difference in a property of the hydrocarbon fluid and a property of the aqueous fluid includes flowing the hydrocarbon fluid through a first passage of the at least one ICD; flowing the aqueous fluid through a second passage of the at least one ICD that is different than the first passage; and flowing the hydrocarbon fluid and the aqueous fluid together from the first and second passages based at least in part on the difference in the property of the hydrocarbon fluid and the property of the aqueous fluid.

In another general implementation, a wellbore flow control system includes a pipe joint including a tubular that extends between threaded ends; and a plurality of flow control apparatus fixed to the tubular between the threaded ends, each of the flow control apparatus including means for receiving a flow of a wellbore fluid into the flow control apparatus at a flow velocity less than a transport velocity of particulates in the wellbore fluid and transmitting the flow of the wellbore fluid to a volume defined by the tubular.

A first aspect combinable with the general implementation further includes means for filtering the flow of wellbore fluid that encloses at least a portion of the plurality of flow control apparatus.

In a second aspect combinable with any of the previous aspects, the means for filtering includes a specified porosity that includes apertures larger than a majority of the particulates.

In a third aspect combinable with any of the previous aspects, the means for receiving the flow of the wellbore fluid is fluidly coupled to an interior of the tubular that includes the volume.

Various implementations of a system for controlling flow in a wellbore may include none, one, some, or all of the following features. For example, the system for controlling flow in a wellbore may resist (e.g., all or in part) plugging (e.g., by particulates from a subterranean zone) in an unconsolidated geological formation. As another example, production of sands, fines, and other particulates to a terranean surface within a wellbore fluid may be minimized or eliminated. As another example, conventional filtering techniques to reduce or help reduce production of such particulates may be minimized (e.g., by using screens of larger porosity) thereby minimizing installation and/or production costs. As yet another example, "hot spots" of high wellbore fluid flow rates through production equipment may be eliminated or minimized, thereby reducing erosion on such equipment due to production of sand or fines or other particulates in the wellbore fluid. As yet another example, flow rates through production (or injection) equipment may be more uniform (e.g., along a length or lengths of production tubing) as compared to conventional techniques The details of one or more implementations are set forth in the accompanying drawings and the description below. Other features, objects, and advantages will be apparent from the description and drawings, and from the claims.

DETAILED DESCRIPTION

According to the present disclosure, a flow control system includes one or more flow control apparatus positioned on a base pipe and in fluid communication with an interior volume of the base pipe. Each flow control apparatus includes one or more ICDs that adjust a flow of a wellbore fluid received at the flow control apparatus from a subterranean zone so that a velocity of the flow of the wellbore fluid provided to the interior volume is less than a transport velocity of sands or fines in the wellbore fluid.

Various implementations of the concepts disclosed herein may be utilized in various orientations and in various configurations. Example orientations include inclined, inverted, horizontal, vertical, and others. The concepts of this patent application are not limited to any of the example implementations disclosed herein.

Directional terms are used to describe the example implementations. Example directional terms include "above," "below," "upper," "lower," and others. The terms "above," "upper," and "upward" may refer to a direction toward the earth's surface along a wellbore. The terms "below," "lower," and "downward" may refer to a direction away from the earth's surface along a wellbore.

Figure 1:
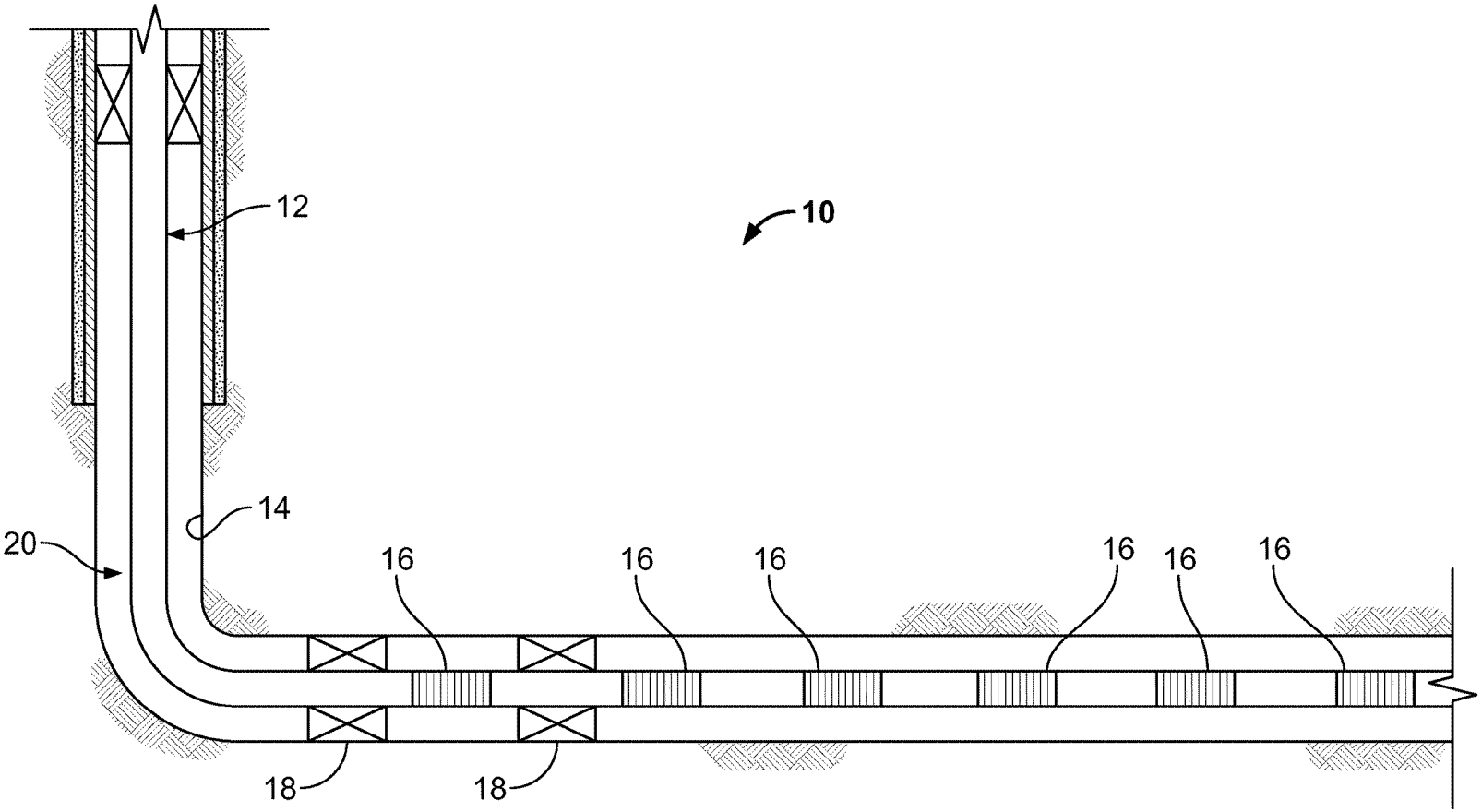
FIG. 1 is a schematic diagram that illustrate a well system that includes one or more inflow control assemblies.

FIG. 1 is a schematic diagram that illustrate a well system 10 that includes one or more inflow control assemblies 16. As illustrated, the well system 10 includes a completion string 12 installed in a wellbore 14 of a well, thereby defining an annulus 20 between the wellbore 14 and the string 12. The completion string 12 includes multiple inflow control assemblies 16 positioned in an uncased generally horizontal portion of the wellbore 14. Generally, the completion string 12 is an assembly of equipment that includes a tubular conduit and extends through all or a portion of the wellbore 14. The completion string 12 may be separate from or anchored to a casing of the wellbore 14. The completion string 12 is permanently or semi-permanently installed in the wellbore 14, and is the primary equipment used to produce the well over its expected life.

The packers 18 seal or substantially seal against passage of fluids between a wall of the wellbore 14 and the completion string 12, and thus isolate portions of the wellbore 14 from other portions of the wellbore 14. As illustrated, one or more of the inflow control assemblies 16 may be positioned in an isolated portion of the wellbore 14, for example, between packers 18 set in the wellbore. In addition, or alternatively, many of the inflow control assemblies 16 could be positioned in a long, continuous portion of the wellbore 14, without packers isolating the wellbore between the screens.

Gravel packs could be provided about any or all of the inflow control assemblies 16, if desired. A variety of additional well equipment (such as valves, sensors, pumps, control and actuation devices, etc.) could also be provided in the well system 10.

The well system 10 is merely representative of one well system in which the principles of the present disclosure may be beneficially utilized. However, the invention is not limited in any manner to the details of the well system 10 described herein. For example, the inflow control assemblies 16 could instead be positioned in a cased and perforated portion of a wellbore, the inflow control assemblies 16 could be positioned in a generally vertical portion of a wellbore, the inflow control assemblies 16 could be used in an injection well, rather than in a production well. For example, although shown in the context of a horizontal well system 10, the concepts herein can be applied to other well configurations, including vertical well systems consisting of a vertical or substantial vertical wellbore, multi-lateral well systems having multiple wellbores deviating from a common wellbore and/or other well systems. Also, although described in a production context, concepts herein can are applicable in other contexts, including injection (e.g., with the inflow control assemblies 16 as part of an injection string), well treatment (e.g., with the inflow control assemblies 16 as part of a treatment string) and/or other applications.

In one alternative example, the string 12 can be used to inject stimulating fluids (e.g., acid in an acidizing treatment, steam in a heated fluid injection treatment, and/or other types of stimulating fluid) into a subterranean zone that surrounds the wellbore 14 (e.g., a horizontal portion of the wellbore 14). Thereafter, the string 12 can be used to produce fluids (e.g., hydrocarbons and/or other fluids) from the subterranean zone substantially uniformly, or in some other flow profile, along the length of the production/injection interval. In another example, the string 12 is used for injection of sweeping fluids (e.g., water, brine and/or other fluids) into the subterranean zone substantially uniformly, or in some other flow profile, along the length of the production/injection interval for the purpose of maintaining pressure in the subterranean zone and sweeping the zone's fluids to a specified location in the subterranean zone. The well may be shut-in while the sweeping fluids reside in the subterranean zone. In certain instances, the greater resistance or sealing against inflow into the string 12 can limit cross-flow of fluids from one sub-interval, through the string 12 and out to another sub-interval. Thereafter, the string 12 is used to produce fluids (e.g., hydrocarbons and/or other fluids) from the subterranean zone substantially uniformly, or in some other flow profile, along the length of the production/injection interval.

During the production of fluids from the subterranean zone, each of the illustrated flow control apparatus 16 may receive a wellbore fluid (e.g., a gas or liquid or multiphase hydrocarbon fluid) from the subterranean zone that is produced into the annulus 20. Once received from the annulus 20, the flow control apparatus 16 may transmit the wellbore fluid to an interior of the completion string 12, such as to an interior of a tubular joint, or "pipe joint," that makes up the completion string 12. In other example embodiments, the flow control apparatus 16 may transmit the wellbore fluid to an interior of a coiled tubing that makes up the completion string 12. Wellbore fluid produced into the completion string 12 may be further produced to the terranean surface.

As described in more detail below, each of the flow control apparatus 16 may include one or more inflow control devices ("ICDs") that adjust a flow rate and/or flow velocity of the wellbore fluid received into the flow control apparatus 16 from the annulus 20. Examples of ICDs can include, for instance, nozzle type ICDs, orifice-type ICDs, helix channel ICDs, valves, tubings, and autonomous ICDs (e.g., microfluidic or vortex type ICDs). As further examples, ICDs may include flow channels that direct and/or adjust a flow of the wellbore fluid as it is distributed through the flow control apparatus 16. ICDs may include vanes mounted in flow paths that direct and/or adjust a flow of the wellbore fluid as it is distributed through the flow control apparatus 16. ICDs may include posts or other textured surfaces that direct and/or adjust a flow of the wellbore fluid as it is distributed through the flow control apparatus 16.

In example implementations, the ICDs are autonomous ICDs ("AICDs"). AICDs may include an autonomous valve that autonomously (i.e., without human or other interaction) changes between allowing and restricting against flow to the completion string 12 from the annulus 20 in response to a fluid flow characteristic, such as, at least one of fluid flow rate, viscosity or density. For example, an autonomous valve can become more restrictive of fluid flow as the flow rate increases and less restrictive as the flow rate decreases or vice versa. An autonomous valve can become more restrictive of fluid flow as the viscosity fluid increases and less restrictive of viscosity of the fluid decreases or vice versa. An autonomous valve can become more restrictive of fluid flow as the fluid density increases and less restrictive as the fluid density decreases or vice versa. In certain instances, an autonomous valve can automatically be more restrictive to water than oil or vice versa, more restrictive to gas than oil or vice versa, and/or more restrictive to production flow (e.g., flow from the wellbore 14 into the interior of the completion string 12) than to injection flow (e.g., flow from the interior of the completion string 12 into the wellbore 14) or vice versa.

Several examples of autonomous valves that could be used as the autonomous valve are disclosed in U.S. patent Publication Ser. No. 12/700,685, entitled "METHOD AND APPARATUS FOR AUTONOMOUS DOWNHOLE FLUID SELECTION WITH PATHWAY DEPENDENT RESISTANCE SYSTEM," filed Feb. 4, 2010, the entirety of which is incorporated herein by reference. Still other examples exist. In some examples, autonomous valves (e.g., an AICD) include no moving parts. The autonomous valve includes multiple passages, each having a different resistance to flow in relation to a characteristic of the fluid flow. The passages include fluid diodes that provide resistance to flow based on the density, viscosity, and/or velocity of the fluid they receive. The multiple passages feed into a fluid amplifier and the flows from the passages act on each other to direct the total flow based on the respective momentum of flow from the passages. The amplifier increases the total fluid flow's tendency to flow towards one direction, and thus directs the flow to preferentially enter one or another of multiple outlets. The result is that the resistance to flow through the autonomous valve as a whole depends on the characteristics of the fluid flow, such as its density, viscosity and/or flow rate.

Each flow control apparatus 16 has an exterior housing that, in some cases, is sealed to the completion string 12. Wellbore fluid can be communicated from the annulus 20 to an interior of the housing and to the one or more ICDs.

Figure 2A:
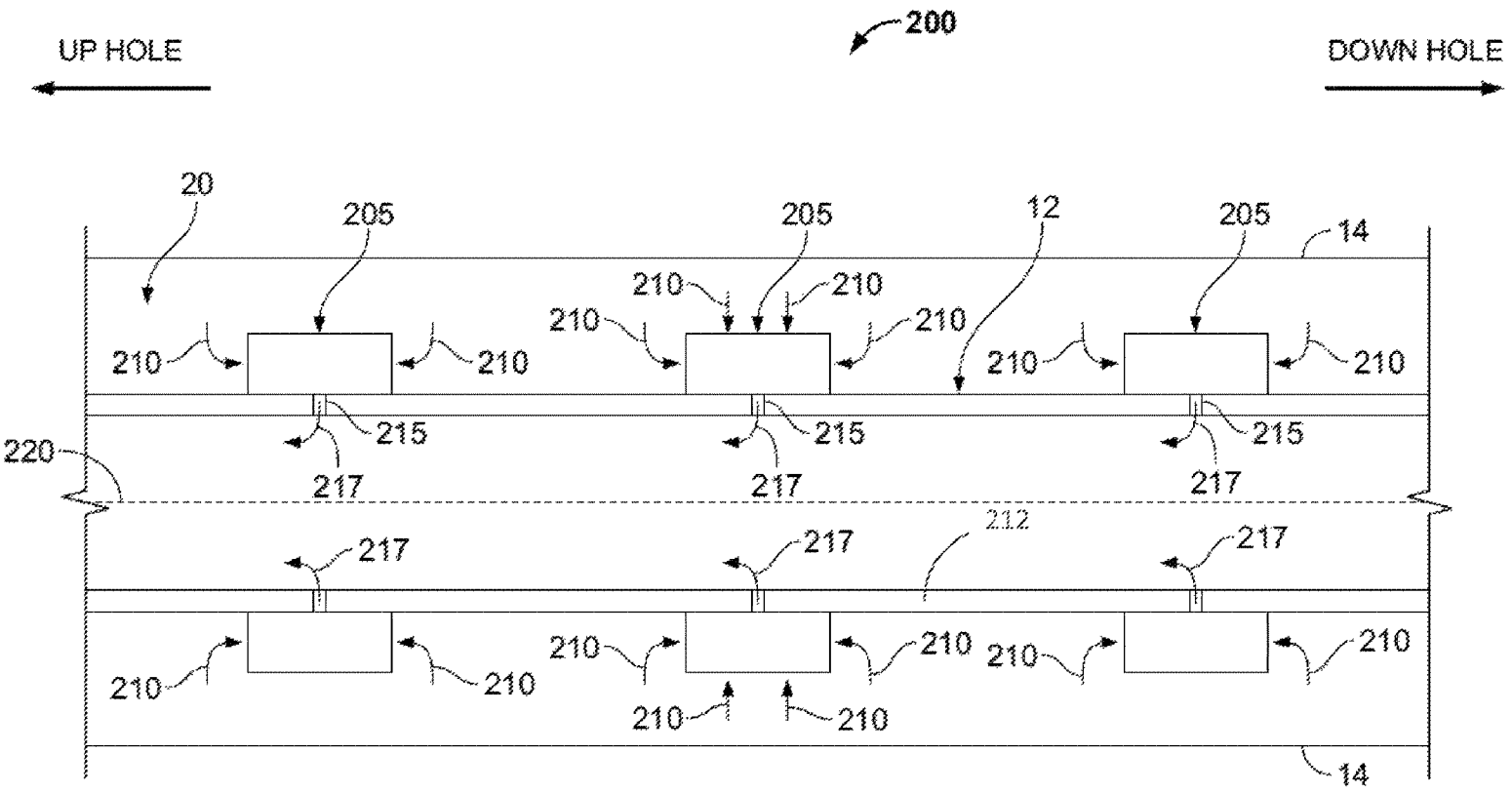
FIGS. 2A-2B are schematic diagrams that illustrate example implementations of flow control systems.
Figure 2B:
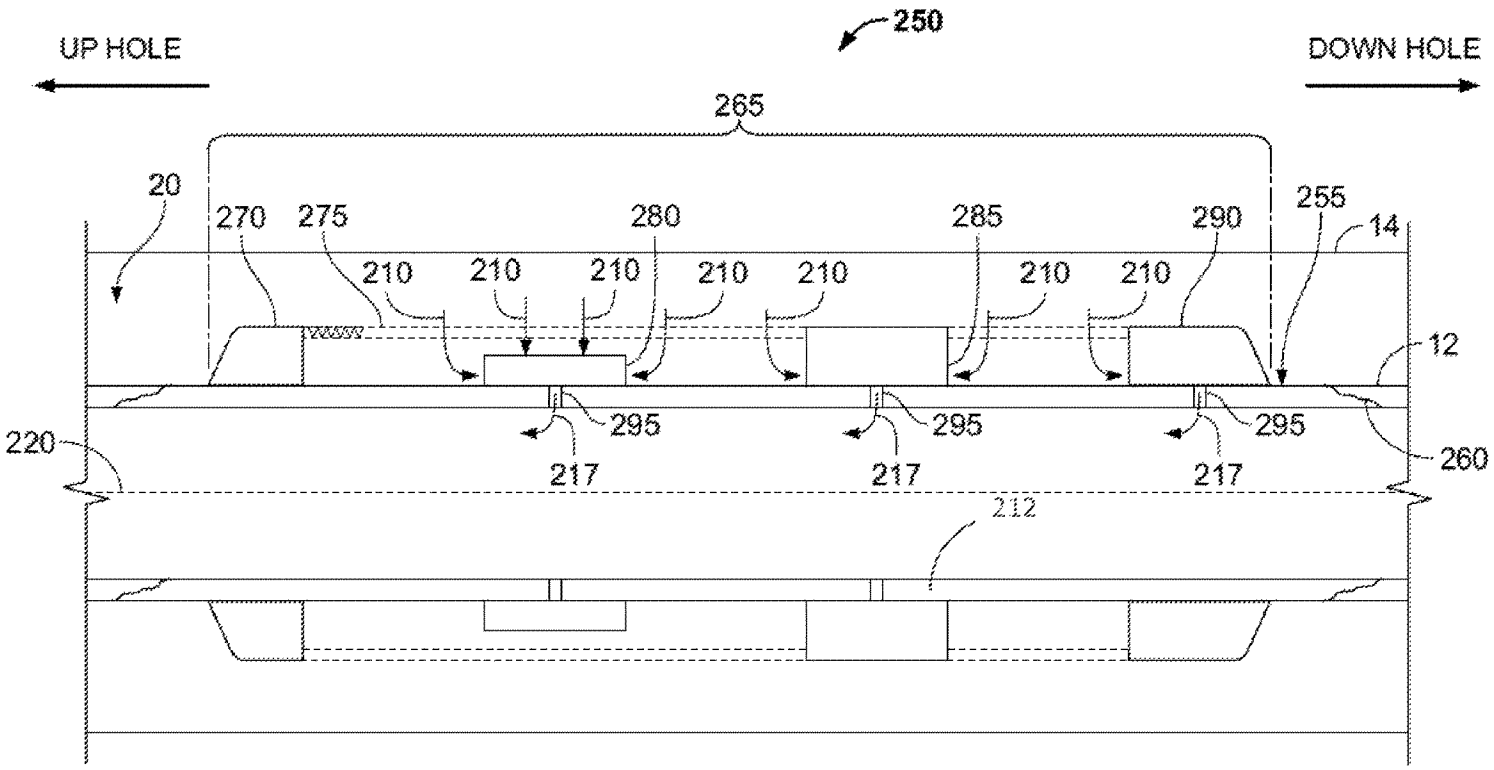

FIGS. 2A-2B are schematic diagrams that illustrate example implementations of flow control systems 200 and 250, respectively. Generally, at a high level, the flow control systems 200 and 250 each include multiple flow control apparatus that are mounted or coupled to a base pipe (e.g., a pipe joint of a tubing string such as completion string 12). Each of the multiple flow control apparatus includes one or more ICDs that receive a flow of a wellbore fluid from a subterranean formation and adjust the flow so that a velocity of the flow of the wellbore fluid to an interior of the base pipe is below (e.g., slightly or significantly) a transport velocity of fines (e.g., sand or other particulates) carried in the wellbore fluid.

In some aspects, a transport velocity of fines may be determined based on a terminal settling velocity of the fines (e.g., sand or other particulates) in the wellbore fluid. The terminal velocity of the fines in a fluid at rest is determined according to the weight of the fines, the cross sectional area of the fines, the density of the fluid, and the drag coefficient. For example, the terminal velocity of a particle is determined according to the equation:

$$v_t = \sqrt{\frac{2m}{C_d A \rho}},$$

where $v_t$ is the terminal settling velocity, m is the mass of the particle, $C_d$ is the drag coefficient, A is the cross-sectional area of the particle, and p is the fluid density.

The transport velocity is related to the terminal settling velocity by a factor which can be, in some instances, about 10. Thus, the transport velocity of the particle (e.g., fines, sand, or otherwise) is about 10 times the determined terminal settling velocity. In some aspects, sand transport velocities, for example, can range from between about 0.001 m/s to 10 m/s and more optimally, between about 0.1 m/s and 0.6 m/s. Thus, the ICDs adjust the flow of a wellbore fluid that includes sand so that a velocity of the flow of the wellbore fluid to the interior of the base pipe is below between about 0.1 and 0.6 m/s in some aspects.

As illustrated, the flow control system 200 includes inflow control assemblies 205 that receive a flow of a wellbore fluid 210 from the annulus 20 and transmit the wellbore fluid 217 through conduits 215 to an interior 220 of a base pipe 212. In some aspects, the base pipe 212 is a single pipe joint that is can be coupled (e.g., threadingly) to additional pipe joints on both ends of the base pipe 212 or other downhole tools. For example, in some aspects the base pipe 212 is one of a Range 1 (e.g., between about 16-25 ft.), Range 2 (e.g., between about 25-34 ft.), or Range 3 pipe joint. In the case of a Range 3 pipe joint, the base pipe 212 may be threaded on both ends and be 34-48 ft. or about 40 ft. long.

In the case of the base pipe 212 comprising a single pipe joint, the conduits 215 may be apertures formed in the pipe 212 and, in some cases, multiple apertures from an exterior of the pipe 212 to the interior 220 may be formed around the circumference of the base pipe 212. In other cases, the base pipe 212 may include all or portions of several pipe joints that are coupled together (e.g., threadingly or otherwise). For example, in such implementations, a particular flow control apparatus 205 may act as a coupling between two pipe joints of the base pipe 212 in that the apparatus 205 may be coupled (e.g., threadingly) to an end of two adjacent pipe joints, thereby forming a coupling between the pipe joints. In such aspects, the conduit 215 may simply be a gap between the ends of the pipe joints that form the base pipe 212.

As illustrated in FIG. 2A, flow of the wellbore fluid 210 may enter the multiple flow control apparatus 205 through one or multiple surfaces of the apparatus 205. For example, in some aspects, the wellbore fluid 210 may enter only axially-facing surfaces (e.g., facing in an uphole and/or downhole direction in a vertical wellbore). In some aspects, the wellbore fluid 210 may enter only a radially-facing surface (e.g., facing the wellbore 14). In some aspects, the wellbore fluid 210 may enter axially-facing surfaces and radially-facing surfaces.

Turning to FIG. 2B, the flow control system 250 is illustrated, which includes multiple flow control apparatus 280, 285, and 290 positioned on a base pipe 255 that is coupled to another base pipe (or other base pipes) through a connection 260 (e.g., a threaded connection). The system 250, as illustrated, also includes a filter 275 (e.g., screen, mesh, perforated shroud, prepack screen, or otherwise) that extends between an end housing 270 and an end flow control apparatus 290. The filter 275, in some aspects, may be sized (e.g., have a porosity) to prevent particular size particles (e.g., larger than fines or sand) from traversing the filter 275 while allowing smaller particles (e.g., fines or sand or otherwise) from traversing the filter 275 in the wellbore fluid 210.

In some example implementations, the flow control system 250 (and other flow control systems described herein) may not include the filter 275. For example, because a flow velocity of the wellbore fluid 210 that enters one or more ICDs in each flow control apparatus 280, 285, and/or 290 is below a transport velocity for fines and/or sand in the fluid 210, a filter may be unnecessary to prevent and/or limit the production of such particles in the wellbore fluid 217 (as well as clogging and other problems). The sand and/or fines would not be transported into the ICDs in such example implementations. In some example aspects, however, the filter 275 may not be configured to prevent and/or limit the passage of sand and/or fines but instead, be configured to, for example, withstand a wellbore collapse or to hold a gravel pack in place to support the wellbore. In some aspects, such a filter 275 may include a screen that uses a relatively larger gauge that, in conventional systems, allows fines and/or sands to pass through. But, in accordance with the present disclosure, the filter 275 may not be exposed to sands and/or fines as the flow velocity through such a filter may be less than the transport velocity of sand and/or fines.

In further implementations, the filter 275 may screen or filter fines and/or sand but in much less of a quantity due to the lower flow velocity of the wellbore fluid 210. The filter 275, therefore, may never or rarely experience plugging or other maintenance issues.

As illustrated, the end housing 270 is mounted on or coupled to the base pipe 255 at, for example, an uphole end and may not, in this example, receive a flow of the wellbore fluid 210. The end housing 270, as shown, may simply provide an end connection for the filter 275. At the other end of the filter 275, the end flow control apparatus 290 provides a second connection for the filter 275 and also receives a flow of the wellbore fluid 210 that is transmitted through an ICD to a conduit 295 and exits out as wellbore fluid 217 to the interior 220 of the base pipe 255. As illustrated, the end flow control apparatus 290 may only receive the wellbore fluid 210 at a axially-facing surface.

Inflow control apparatus 280 and 285 are positioned, in this example, between the end housing 270 and the end flow control apparatus 290. In this example, the flow control apparatus 280 is positioned on the base pipe 255 underneath the filter 275, thereby allowing, in some aspects, the wellbore fluid 210 to flow into axially-facing and radially-facing surfaces of the apparatus 280. Further, in this example, the flow control apparatus 285 is positioned and sized (e.g., a housing of the apparatus) to intersect the filter 275. The flow control apparatus 285, therefore, in this example, may receive the wellbore fluid 210 into axially-facing surfaces of the apparatus 285.

As with the system 200, each of the flow control apparatus of system 250 (e.g., apparatus 280, 285, and/or 290) includes one or more ICDs that receive the wellbore fluid 210 from the annulus and adjust the flow so that the velocity of the flow of the wellbore fluid 210 to the ICDs in the apparatuses 280, 285, and 290 is below (e.g., slightly or significantly) a transport velocity of fines (e.g., sand or other particulates) carried in the wellbore fluid 210. In this example, the combination of the end housing 270, inflow control apparatuses 280, 285, and 290, and base pipe 255 comprise an inflow control assembly 265. In some instances, the filter 275 is also part of the inflow control assembly 265. Further, other implementations of system 250 exist. For example, the system 250 may include more flow control apparatus, may only include one or more flow control apparatus 280 or 285, may include two end flow control apparatus 290, or may include multiple pipe joints (e.g., multiple base pipes 255 coupled through connections 260).

In operation, systems 200 and 250 can each be positioned in the wellbore 14 (e.g., in a horizontal portion, a vertical portion, a leg, or otherwise). Wellbore fluid 210 flows from the wellbore 14 into the annulus (e.g., from an open hole completion, from a perforated casing, or otherwise). The fluid 210 flows into the illustrated flow control apparatus (and in some cases through the filter 275 first) and into one or more ICDs positioned in each flow control apparatus. The wellbore fluid 210 flows into the flow control apparatus at a velocity that is less than or significantly less than the transport velocity of the fines or sand and thus, such particulates are not carried along in the fluid 210. The ICDs in the flow control apparatus regulate the flow of the fluid 210 into the housings. The flow 217 exiting the ICDs (e.g., through the conduits 295 and into the interior 220 of the base pipe 255) is above the transport velocity of the sands or fines. The wellbore fluid 217 that enters the interior 220 of the base pipe 255 can be produced to the surface, largely free from (or with a reduced amount of) sand or fines In some cases, a particular number or type (e.g., end flow control apparatus 290 and/or flow control apparatus 280 or 285) may be selected based on production criteria. For example, criteria such as desired flow profile, desired flow rate, formation characteristics, and otherwise may determine the number, as well as the type, of flow control apparatus in the inflow control assembly 265.

Figure 3:
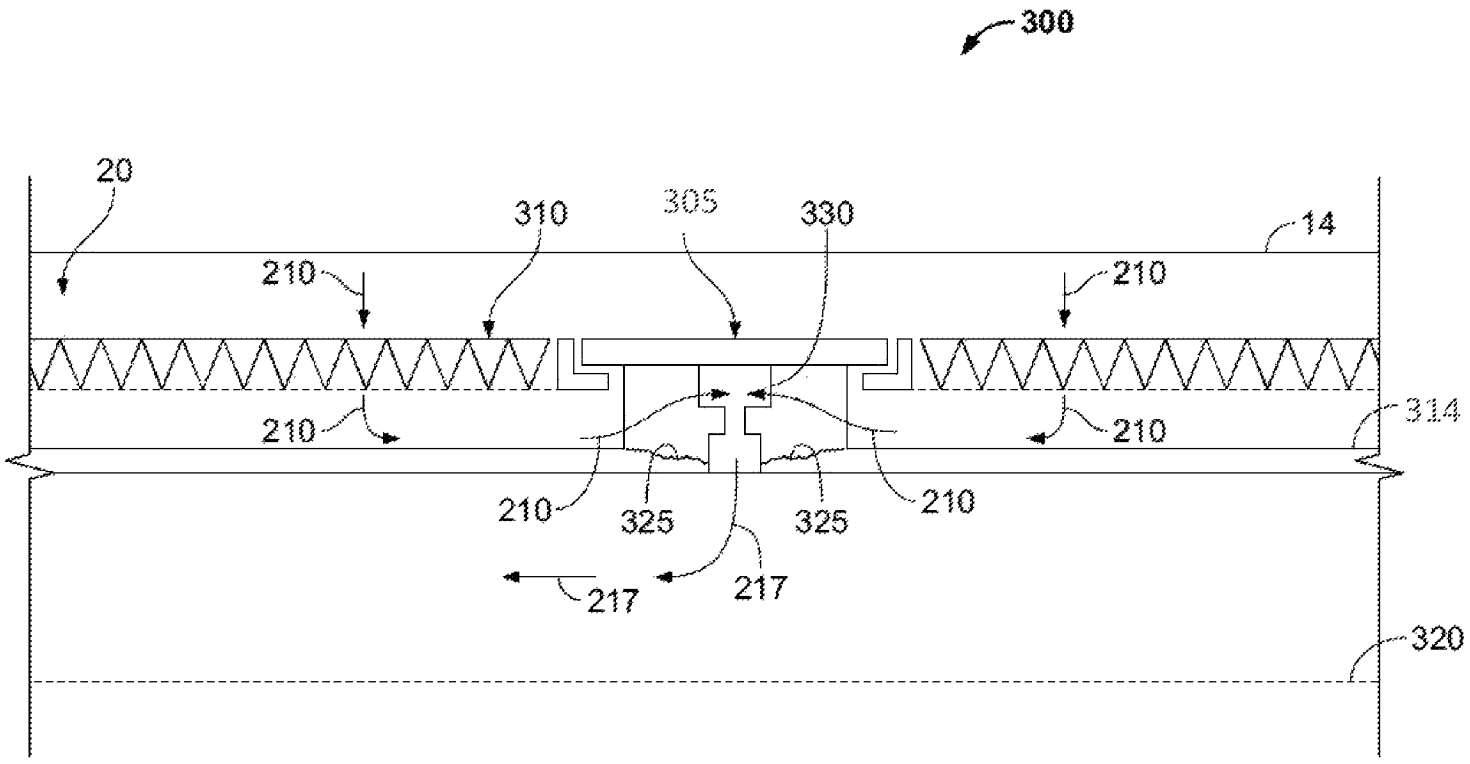
FIG. 3 is a schematic diagram that illustrates another example implementation of a flow control system.

FIG. 3 is a schematic diagram that illustrates another example implementation of a flow control system 300. In this example, a flow control apparatus 305 is used as a coupling to connect (e.g., threadingly) ends 325 of two base pipes 314 that are part of a completion string in a wellbore 14. Further, in this example, filters 310 abut (or are adjacent to) axial sides of the flow control apparatus 305 and comprise wrap on pipe screens.

For example, in this implementation, the filters 310 are depicted as a wire wrapped screen, having a wire helically wrapped around the base pipe 314. The space between adjacent wraps of the wire is closely controlled to be smaller than a specified size of particulate filtered by the filters 310. For example, in some aspects, the filters 310 may be designed to prevent particulates larger than fines or sand from passing through while allowing fines and sands to pass through (thereby decreasing the cost and complexity of the filters 310). Although depicted as a wire wrapped screen, other configurations of screens, including screens having one or more layers of wire wrap, mesh and/or other filtration structures, could be used.

In operation, wellbore fluid 210 passes through the filters 310 radially and enters the flow control apparatus 305 axially, then flows though the radially-facing openings in a housing of the apparatus 305. The fluid 210 enters an ICD 330 at a particular flow rate and flow velocity. The wellbore fluid 310 passes through the ICD 330 (e.g., a nozzle, orifice, helix channel, tubing, AICD, or otherwise) and into the interior 320 of the base pipe 314 to be produced to the surface. In some aspects, the ICD 330 adjusts the velocity and/or rate of the wellbore fluid 210 so that, as the fluid 217 enters the interior 320 of the base pipe 314, the velocity of the fluid 217 is below a transport velocity of sands or fines in the wellbore fluid 210. Alternatively, the flow 210 of the wellbore fluid that enters the ICD 330 is below a transport velocity of sands or fines in the wellbore fluid 210 and the flow 217 into the interior 320 of the base pipe 314 may be above or below the transport velocity of sands or fines in the wellbore fluid 210. In any event, such flow 217 into the interior may be all or largely free of sand and/or fines.

Figure 4A:
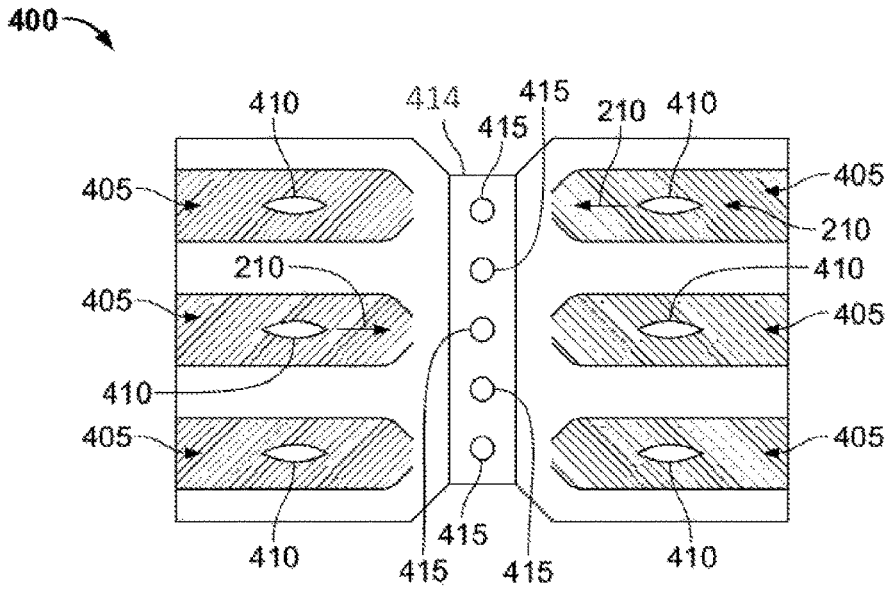
FIGS. 4A-4C are schematic diagrams that illustrate example implementations of inflow control devices that may be used with a flow control system.
Figure 4B:
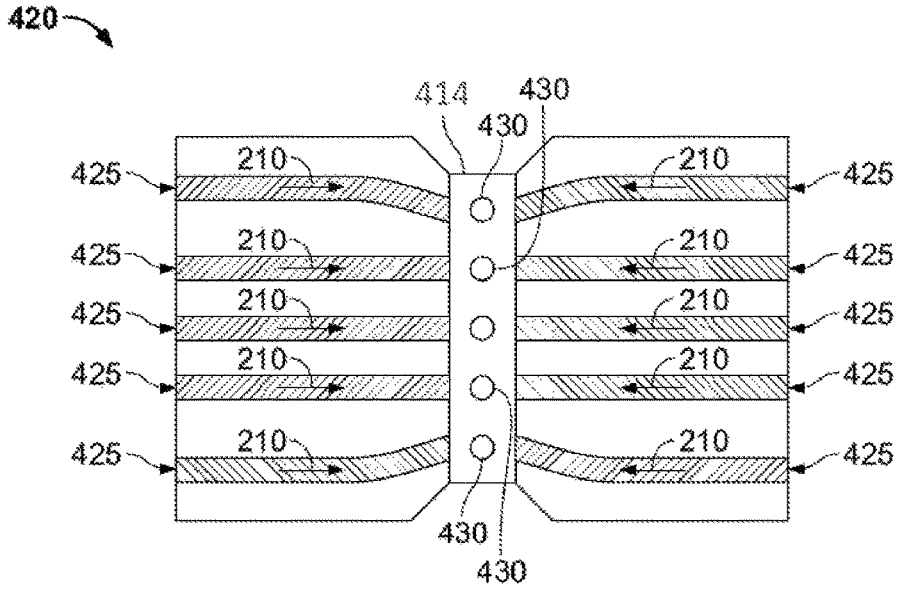
Figure 4C:
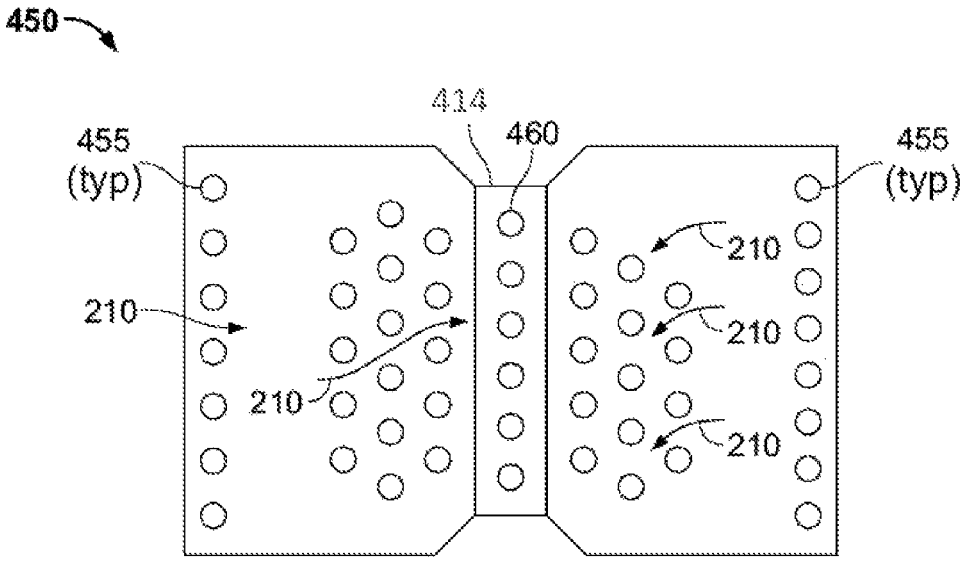

FIGS. 4A-4C are schematic diagrams that illustrate example implementations of inflow control devices 400, 420, and 450, respectively, that may be used with a flow control system (e.g., flow control systems 200, 250, 300, or otherwise). More particularly, one or more of the ICDs 400, 420, and/or 450 can be used in any one of the illustrated flow control apparatus. Other ICDs are also contemplated by the present disclosure beyond these examples illustrated here. Each of the illustrated ICDs can, at a high level, receive a flow of a wellbore fluid from a subterranean formation at a velocity below the transport fine velocity by adjusting the flow so that a velocity is below (e.g., slightly or significantly) a transport velocity of fines (e.g., sand or other particulates) carried in the wellbore fluid.

Turning to FIG. 4A, the ICD 400 includes flow paths 405 that extend (e.g., from a surface of a flow control apparatus exposed to an annulus of a wellbore) to the base pipe 414 that includes multiple apertures 415. The apertures 415 extend from an outer surface of the base pipe 414 to an interior of the base pipe 414. The flow paths 405 include vanes 410 that are positioned in and extend from the flow paths 405. Although a single vane 410 is illustrated in each flow path 405, multiple vanes 410 may be positioned per flow path 405 or some flow paths 405 may not include any vanes 410.

In operation, wellbore fluid 210 flows (e.g., from an annulus through a housing of a flow control apparatus) into the ICD 400 and into the flow paths 410. The wellbore fluid 210 enters the ICD 400 at a particular flow rate and velocity that is less than a transport velocity of sands or fines in the fluid 210. Thus, sands and/or fines in the fluid 210 are not transported through the flow to and, in some cases, into, the ICD 400. Based on the flow paths 405 and vanes 410 (alone or in combination), the velocity of the wellbore fluid 210 is reduced in the ICD 400 to a rate less than the transport velocity of sands or fines contained in the fluid 210. Thus, the fluid 210 entering the apertures 415 may be substantially free of, or have a reduced amount of, fines and sands.

Turning to FIG. 4B, the ICD 420 includes flow paths 425 that extend (e.g., from a surface of a flow control apparatus exposed to an annulus of a wellbore) to the base pipe 414 that includes multiple apertures 430. The apertures 430 extend from an outer surface of the base pipe 414 to an interior of the base pipe 414. The flow paths 425 are illustrated in this example as extending relatively straight to the base pipe 414, however, in alternative implementations, the flow paths 430 (e.g., grooves formed in a surface of the ICD 420) may be zig-zag, curved, circuitous, or otherwise.

In operation, wellbore fluid 210 flows (e.g., from an annulus through a housing of a flow control apparatus) into the ICD 420 and into the flow paths 430. The wellbore fluid 210 enters the ICD 420 at a particular flow rate and velocity that is less than a transport velocity of sands or fines in the fluid 210. Thus, sands and/or fines in the fluid 210 are not transported through the flow to and, in some cases, into, the ICD 420. Based on the flow paths 430, the velocity of the wellbore fluid 210 is reduced in the ICD 420 to a rate less than the transport velocity of sands or fines contained in the fluid 210. Thus, the fluid 210 entering the apertures 430 may be substantially free of, or have a reduced amount of, fines and.

Turning to FIG. 4C, the ICD 450 includes a surface onto which multiple posts 455 or other raised flow obstructions are mounted. The surface extends to the base pipe 414 that includes multiple apertures 460. The apertures 460 extend from an outer surface of the base pipe 414 to an interior of the base pipe 414. As illustrated, multiple posts 455 are positioned on the flow surfaces and can be placed in an ordered pattern, semi-random pattern, or random pattern.

In operation, wellbore fluid 210 flows (e.g., from an annulus through a housing of a flow control apparatus) into the ICD 450 and onto the flow surfaces onto which the posts 455 are mounted. The wellbore fluid 210 enters the ICD 450 at a particular flow rate and velocity that is less than a transport velocity of sands or fines in the fluid 210. Thus, sands and/or fines in the fluid 210 are not transported through the flow to and, in some cases, into, the ICD 450. Based on the posts 455 that present flow obstructions to the wellbore fluid 210, the velocity of the wellbore fluid 210 is reduced in the ICD 450 to a rate less than the transport velocity of sands or fines contained in the fluid 210. Thus, the fluid 210 entering the apertures 460 may be substantially free of, or have a reduced amount of, fines and.

Figure 5A:
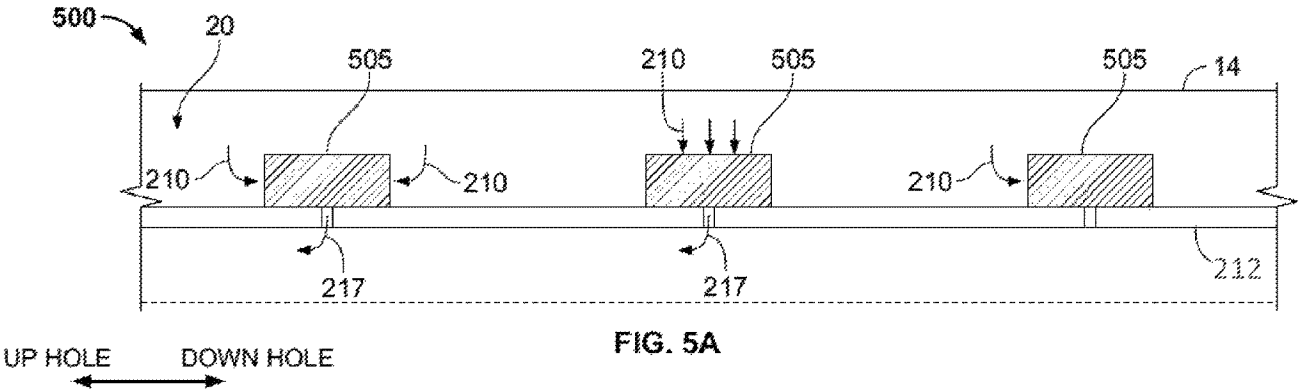
FIGS. 5A-5C are schematic diagrams that illustrate further example implementations of flow control systems.
Figure 5B:
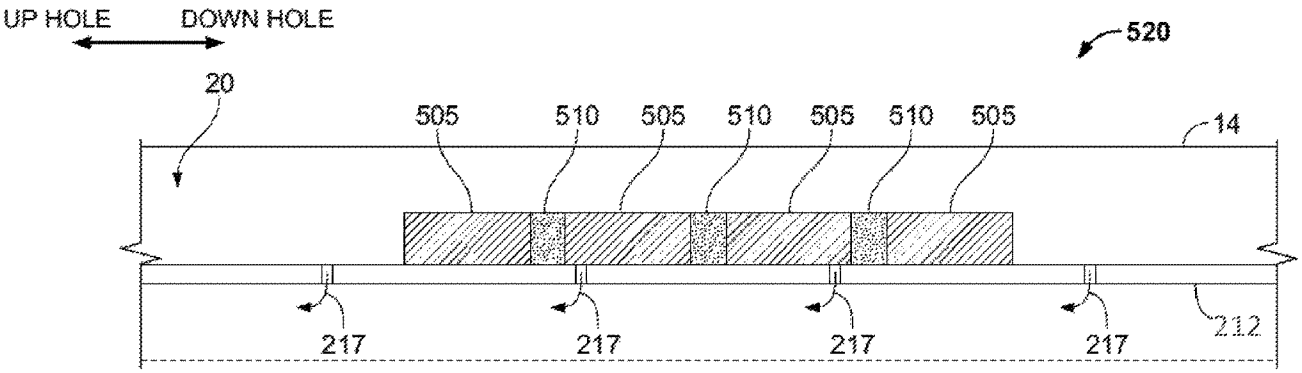
Figure 5C:
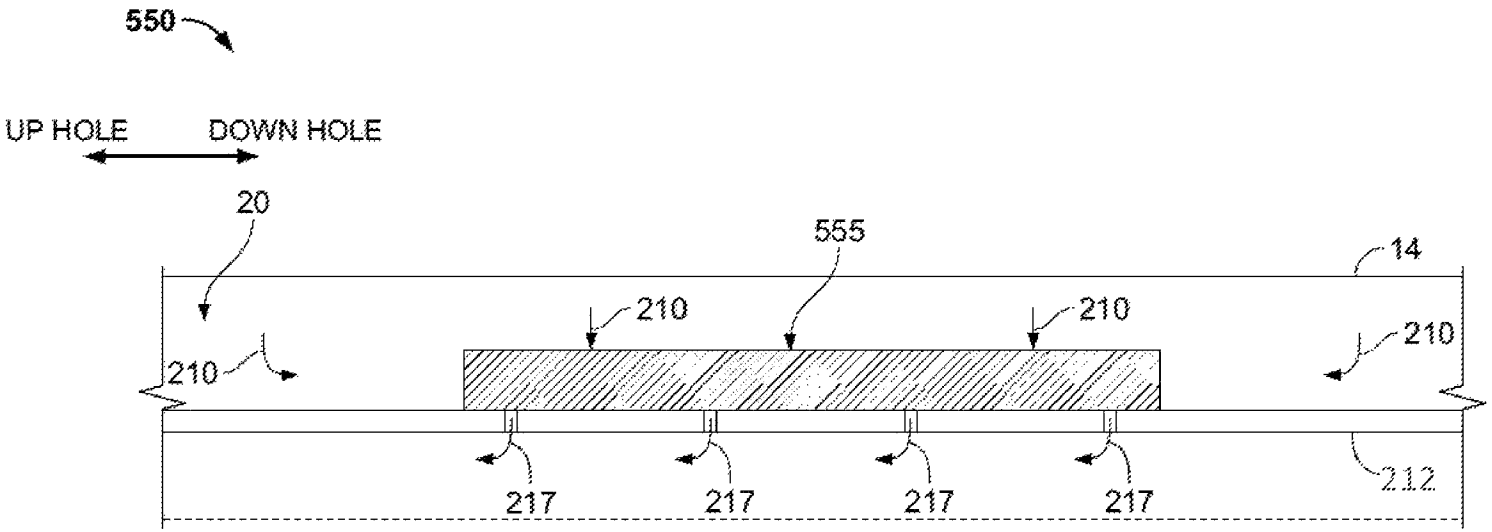

FIGS. 5A-5C are schematic diagrams that illustrate further example implementations of flow control systems 500, 520, and 550, respectively. Generally, one or more of the flow control systems 500, 520, and/or 550 may be used in the well system 10 in conjunction with, or in place of, one or more of the flow control systems 200, 250, and/or 300. Generally, each of the flow control systems 500, 520, and 550 include one or more flow control apparatus mounted on or coupled to a base pipe with a filter that extends over at least a portion of the flow control apparatus. Each of the flow control apparatus includes one or more ICDs that receive a flow of wellbore fluid from an annulus of a wellbore and adjust the flow so that the velocity of the flow of the wellbore fluid to an interior of a base pipe is below (e.g., slightly or significantly) a transport velocity of fines (e.g., sand or other particulates) carried in the wellbore fluid.

Turning particularly to FIG. 5A, the flow control system 500 includes multiple flow control apparatus 505 mounted on or coupled to a base pipe (e.g., completion string 212). In this example, each flow control apparatus is enclosed (e.g., substantially) by a filter (e.g., screen, mesh, or otherwise) and also includes one or more ICDs (e.g., enclosed within the filter) that receives a wellbore fluid 210 from the annulus 20 and provides an adjusted flow of the wellbore fluid 217 to an interior of the completion string 212. The ICDs enclosed within the filters in the flow control apparatus 505 may be, for instance, nozzles, valves, AICDs, or otherwise.

In operation, flow of the fluid 210 is received through the filters of the flow control apparatus 505 and to the ICDs enclosed within the filters. The ICDs, in some aspects, may be set (e.g., according to a number of flow control apparatus 505 on each base pipe joint, according to a type of ICDs used in the flow control apparatus 505, or otherwise) to provide a maximum velocity of the wellbore fluid 210 to the completion string 212, so as to more uniformly distribute flow from the annulus 20 to the completion string 212. In some aspects, the maximum velocity may be set so as to avoid "hot spots" of high flow of the wellbore fluid 210 to the completion string 212. In some aspects, the maximum velocity may allow for the transport of sands or fines in the wellbore fluid 210 into the completion string 212 but at rates in which a flow distribution among the flow control apparatus is uniform, constant, and/or substantially equal. In some aspects, the maximum velocity may be lower than a transport velocity of sands or fines in the wellbore fluid 210.

Turning now to FIG. 5B, the flow control system 520 includes multiple flow control apparatus 505 mounted on or coupled to a base pipe (e.g., completion string 212). In this example, each flow control apparatus is enclosed (e.g., substantially) by a filter (e.g., screen, mesh, or otherwise) and also includes one or more ICDs (e.g., enclosed within the filter) that receives a wellbore fluid 210 from the annulus 20 and provides an adjusted flow of the wellbore fluid 210 to an interior of the completion string 212. The ICDs enclosed within the filters in the flow control apparatus 505 may be, for instance, nozzles, valves, AICDs, or otherwise.

Further, in this example, swell rubber 510 is positioned between adjacent flow control apparatus 505, thereby sealing sections of flow into the flow control apparatus of the wellbore fluid 210. In some aspects, the system 520 may operate substantially similar to the system 500 but flow into axially-facing surfaces of the flow control apparatus 505 may be limited by the swell rubber 510.

Turning now to FIG. 5C, the flow control system 550 includes a single flow control apparatus 555 mounted on or coupled to a base pipe (e.g., completion string 212). In this example, the flow control apparatus 555 is enclosed (e.g., substantially) by a filter (e.g., screen, mesh, or otherwise) and also includes one or more ICDs (e.g., enclosed within the filter) that receives a wellbore fluid 210 from the annulus 20 and provides an adjusted flow of the wellbore fluid 217 to an interior of the completion string 212. The ICDs enclosed within the filters in the flow control apparatus 555 may be, for instance, nozzles, valves, AICDs, or otherwise. In some aspects, the system 550 may operate substantially similar to the systems 500 and/or 520 but a single filter limits particulates (e.g., sand or fines) from reaching the ICDs positioned in the flow control apparatus 555.

A number implementations have been described. Nevertheless, it will be understood that various modifications may be made without departing from the spirit and scope of the disclosure. Accordingly, other implementations are within the scope of the following claims.

What is claimed is:

1. A wellbore flow control apparatus, comprising:

an inflow control assembly engageable with a pipe joint that comprises a proximal end engageable with a first downhole tool and a distal end engageable with a second downhole tool, wherein the inflow control assembly is fluidly located between the pipe joint and one or more associated sand screens located proximate a wellbore, the one or more associated sand screens collectively having a sand screen flow area; and at least one inflow control device (ICD) having an inlet and an outlet mounted in the inflow control assembly, each of the at least one ICDs having an ICD flow area and a collection of each of the at least one ICDs having a collective ICD flow area, and further wherein the collective ICD flow area is sized relative to the sand screen flow area to limit a localized inlet flow velocity of wellbore fluid at the one or more sand screens to a value less than a transport velocity of fines in the wellbore fluid.

2. The wellbore flow control apparatus of claim 1, wherein the inflow control assembly comprises a housing engageable with the pipe joint, the at least one ICD mounted at least partially within the housing.

3. The wellbore flow control apparatus of claim 2, wherein at least a portion of the one or more sand screens extends to enclose at least a portion of the ICD.

4. The wellbore flow control apparatus of claim 3, wherein the at least a portion of the one or more sand screens extends to enclose the plurality of ICDs.

5. The wellbore flow control apparatus of claim 3, wherein the at least a portion of the one or more sand screens comprises a plurality of filter sections, each filter section enclosing at least a portion of one of the plurality of ICDs.

6. The wellbore flow control apparatus of claim 1, further including a plurality of inflow control assemblies, wherein at least one of the plurality of inflow control assemblies comprises an end inflow control assembly, the end inflow control assembly comprising a wellbore fluid inlet positioned on only one axial surface of the end inflow control assembly.

7. The wellbore flow control apparatus of claim 6, wherein another of the at least one of the plurality of inflow control assemblies comprises a middle inflow control assembly engageable with the pipe joint between the end inflow control assembly and one of the proximal or distal ends of the pipe joint, the middle inflow control assembly comprising wellbore fluid inlets positioned on respective axial surfaces of the middle inflow control assembly.

8. The wellbore flow control apparatus of claim 7, wherein the middle inflow control assembly comprises another wellbore fluid inlet positioned on a radial surface of the middle inflow control assembly.

9. The wellbore flow control apparatus of claim 7, wherein at least a portion of the one or more sand screens extends between the end inflow control assembly and another end flow control assembly such that a radial gap is defined between an outer surface of the pipe joint and the at least a portion of the one or more sand screens.

10. The wellbore flow control apparatus of claim 9, wherein the middle inflow control assembly is engageable with the pipe joint in the gap and between the at least a portion of the one or more sand screens and the outer surface of the pipe joint.

11. The wellbore flow control apparatus of claim 9, wherein a porosity of the filter at least a portion of the one or more sand screens is selected so that fines in the wellbore fluid flow through the at least a portion of the one or more sand screens with the wellbore fluid.

12. The wellbore flow control apparatus of claim 9, wherein the at least a portion of the one or more sand screens comprises at least one of a wire wrap, a mesh screen, a slotted liner, a perforated shroud, or a prepack screen.

13. A method for controlling flow of a wellbore fluid, comprising:

positioning an inflow control assembly on a pipe joint in a wellbore, the pipe joint comprising a proximal end engageable with a first downhole tool and a distal end engageable with a second downhole tool, wherein the inflow control assembly is fluidly located between the pipe joint and one or more associated sand screens located proximate the wellbore, the one or more associated sand screens collectively having a sand screen flow area;

receiving a flow of a wellbore fluid from a subterranean zone to an inlet of at least one inflow control device (ICD), the at least one ICD mounted in the inflow control assembly, each of the at least one ICDs having an ICD flow area and a collection of each of the at least one ICDs having a collective ICD flow area, and further wherein the collective ICD flow area is sized relative to the sand screen flow area to limit the flow to a velocity that is less than the transport velocity of fines in the wellbore fluid; and transmitting the flow of the wellbore fluid to the pipe joint from the ICDs to an interior of the pipe joint.

14. The method of claim 13, further comprising:

receiving the flow of the wellbore fluid at a housing that at least partially encloses the ICD; and distributing the flow of the wellbore fluid through a portion of the housing to the ICD.

15. The method of claim 14, wherein distributing the flow of the wellbore fluid through a portion of the housing to the ICD comprises distributing the flow of the wellbore fluid through one or more axially-facing inlets of the housing.

16. The method of claim 15, wherein distributing the flow of the wellbore fluid through a portion of the housing to the ICD further comprises distributing the flow of the wellbore fluid through a radially-facing inlet of the housing.

17. The method of claim 13, further comprising receiving the flow of the wellbore fluid through at least a portion of the one or more sand screens that extends at least partially between the proximal and distal ends of the pipe joint and into a radial gap defined between an outer surface of the pipe joint and the at least a portion of the one or more sand screens.

18. The method of claim 17, wherein receiving the flow of the wellbore fluid through the at least a portion of the one or more sand screens comprises:

receiving fines in the flow of the wellbore fluid through the at least a portion of the one or more sand screens; and circulating the fines in the flow of the wellbore fluid to the inlet of the at least one ICD.

19. The method of claim 13, wherein receiving a flow of a wellbore fluid at a velocity that is less than the transport velocity of fines in the wellbore fluid comprises:

restricting a flow rate of the wellbore fluid entering the at least one ICD based on a property of the wellbore fluid; and modifying a velocity of the flow of the wellbore fluid to be less than the transport velocity of fines in the wellbore fluid based on the restriction.

20. The method of claim 19, wherein the wellbore fluid comprises a hydrocarbon fluid and an aqueous fluid, and restricting a flow rate of the wellbore fluid entering the at least one ICD based on a property of the wellbore fluid comprises:

restricting a flow rate of the wellbore fluid entering the at least one ICD based on a difference in a property of the hydrocarbon fluid and a property of the aqueous fluid.

21. The method of claim 20, wherein the property comprises a viscosity, a velocity, or a density of the wellbore fluid.

22. The method of claim 20, wherein restricting a flow rate of the wellbore fluid entering the at least one ICD based on a difference in a property of the hydrocarbon fluid and a property of the aqueous fluid comprises:

flowing the hydrocarbon fluid through a first passage of the at least one ICD;

flowing the aqueous fluid through a second passage of the at least one ICD that is different than the first passage; and flowing the hydrocarbon fluid and the aqueous fluid together from the first and second passages based at least in part on the difference in the property of the hydrocarbon fluid and the property of the aqueous fluid.

23. A wellbore flow control system, comprising:

a pipe joint comprising a tubular that extends between threaded ends; and a flow control apparatus fixed to the tubular between the threaded ends and one or more associated sand screens, the one or more associated sand screens collectively having a sand screen flow area, the flow control apparatus including at least one inflow control device (ICD), each of the at least one ICDs having an ICD flow area and a collection of each of the at least one ICDs having a collective ICD flow area, and further wherein the collective ICD flow area is sized relative to the sand screen flow area to limit a localized inlet flow velocity of wellbore fluid at the one or more sand screen to a value less than a transport velocity of fines in the wellbore fluid.

* * * * *